US008720603B2

(12) United States Patent
Bauer et al.

(10) Patent No.: US 8,720,603 B2
(45) Date of Patent: May 13, 2014

(54) UNDERWATER DRILLING ARRANGEMENT AND METHOD FOR MAKING A BORE

(75) Inventors: Thomas Bauer, Schrobenhausen (DE); Stefan Michael Finkenzeller, Reichertshofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 2 days.

(21) Appl. No.: 13/592,332

(22) Filed: Aug. 22, 2012

(65) Prior Publication Data

US 2013/0220700 A1 Aug. 29, 2013

(30) Foreign Application Priority Data

Aug. 23, 2011 (EP) ..... 11006880

(51) Int. Cl.
*E21B 7/124* (2006.01)
*E21B 4/18* (2006.01)

(52) U.S. Cl.
CPC .. *E21B 7/124* (2013.01); *E21B 4/18* (2013.01)
USPC ..... 175/6; 175/10; 166/358

(58) Field of Classification Search
CPC ..... E21B 7/124; E21B 4/18; E21B 19/002; E02D 7/28
USPC ..... 175/5–8, 10, 207, 92, 103, 122, 162, 175/202, 203, 321; 166/358, 71, 78.1; 405/228, 232, 249, 253
See application file for complete search history.

(56) References Cited

U.S. PATENT DOCUMENTS

| | | | | | |
|---|---|---|---|---|---|
| 2,023,966 | A | * | 12/1935 | Montee | 405/249 |
| 2,655,885 | A | | 10/1953 | Kostro | |
| 2,669,431 | A | * | 2/1954 | Crowell | 175/1 |
| 3,282,356 | A | * | 11/1966 | Paulson et al. | 175/103 |
| 3,500,678 | A | | 3/1970 | Romondt Vis | |
| 3,519,071 | A | * | 7/1970 | Word, Jr. | 166/351 |
| 3,602,320 | A | * | 8/1971 | Howard | 175/8 |
| 3,608,652 | A | * | 9/1971 | Medders et al. | 175/7 |

(Continued)

FOREIGN PATENT DOCUMENTS

| | | |
|---|---|---|
| DE | 1 648 696 | 8/1971 |
| DE | 35 15 276 A1 | 10/1986 |

(Continued)

OTHER PUBLICATIONS

European Search Report dated Jan. 23, 2012 from corresponding European Patent Application No. EP 11 00 6880.

*Primary Examiner* — Matthew Buck
(74) *Attorney, Agent, or Firm* — Studebaker & Brackett PC

(57) ABSTRACT

The invention relates to an underwater drilling arrangement for making a bore in the bed of a lake, sea or river with a platform which can be lowered for positioning on the bed of the lake, sea or river, a drill drive which is arranged on the service platform and a drill rod with drill head which can be driven in rotation via the drill drive. It is provided that the service platform comprises a guide tube, on the inner side of which at least one linear guide is arranged, along which at least one part of the drill drive is guided axially displaceably and the guide tube is held so that it can be adjusted and fixed in a mount of the service platform. The invention further relates to a method for creating a bore in the bed of a lake, sea or river.

14 Claims, 13 Drawing Sheets

(56) References Cited

U.S. PATENT DOCUMENTS

Figure 1:
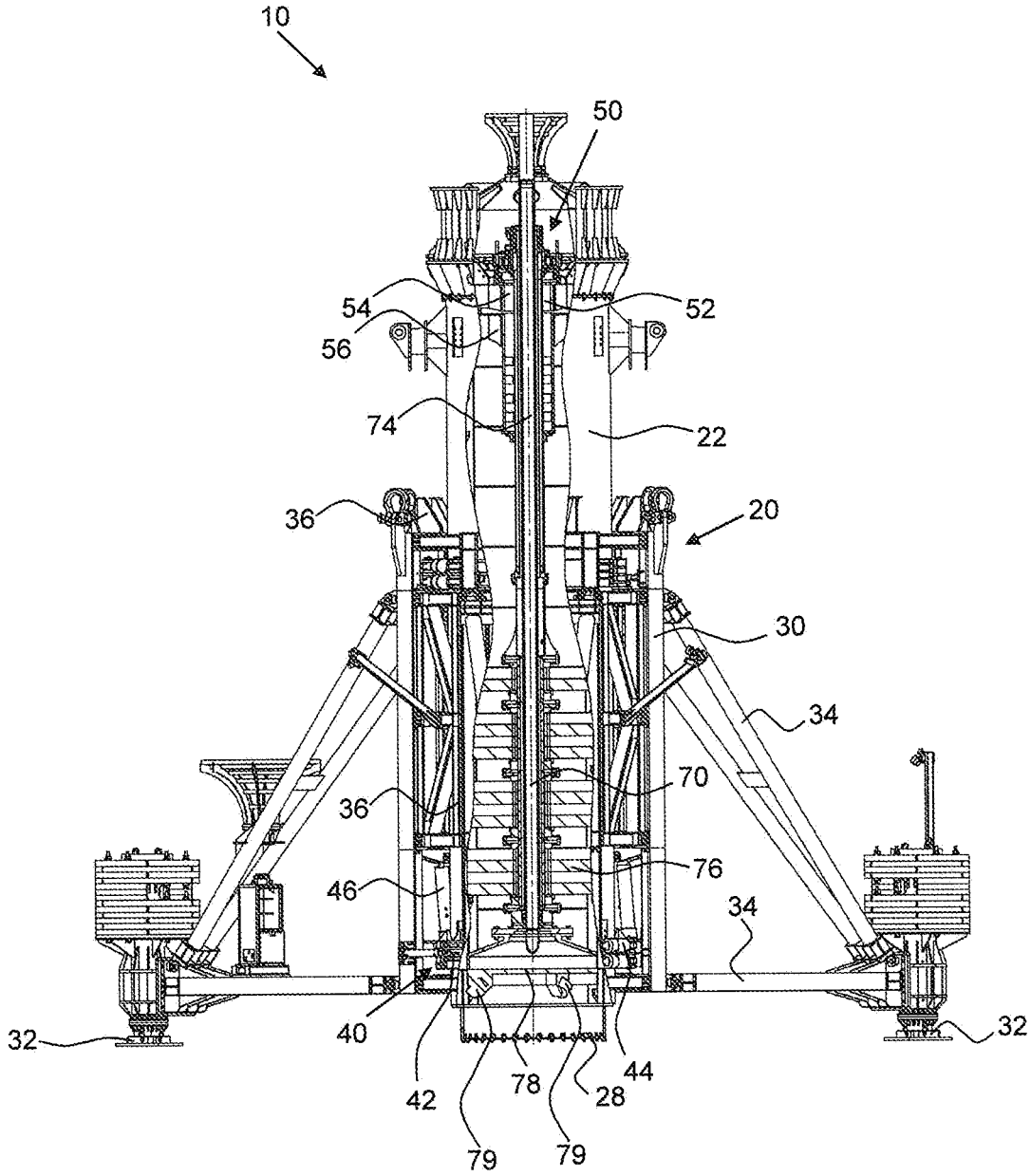

| | | | | | |
|---|---|---|---|---|---|
| 3,621,910 | A * | 11/1971 | Sanford et al. | 166/335 |
| 3,631,932 | A * | 1/1972 | Lindelof | 175/6 |
| 3,635,295 | A * | 1/1972 | Cobbs | 175/257 |
| 3,672,447 | A * | 6/1972 | Kofahl | 166/338 |
| 3,732,143 | A * | 5/1973 | Joosse | 175/6 |
| 4,043,407 | A * | 8/1977 | Wilkins | 175/50 |
| 4,255,068 | A * | 3/1981 | Valantin | 405/195.1 |
| 4,352,595 | A * | 10/1982 | Scodino | 405/158 |
| 4,510,985 | A * | 4/1985 | Arnim et al. | 175/7 |
| 4,558,744 | A * | 12/1985 | Gibb | 166/335 |
| 4,742,876 | A * | 5/1988 | Barthelemy et al. | 175/7 |
| 4,744,698 | A * | 5/1988 | Dallimer et al. | 405/226 |
| 4,770,255 | A * | 9/1988 | Barthelemy et al. | 175/6 |
| 4,904,119 | A * | 2/1990 | Legendre et al. | 405/228 |
| 6,273,645 | B1 * | 8/2001 | Hamre | 405/224.1 |
| 6,484,820 | B1 * | 11/2002 | Tibussek et al. | 175/62 |
| 7,380,614 | B1 * | 6/2008 | Williamson et al. | 175/6 |
| 7,381,011 | B2 * | 6/2008 | Bogle | 405/248 |
| 7,703,534 | B2 * | 4/2010 | Sheshtawy | 166/358 |
| 2008/0226398 | A1 | 9/2008 | Gibberd et al. | |
| 2009/0218136 | A1 * | 9/2009 | Asakawa et al. | 175/6 |
| 2010/0119309 | A1 * | 5/2010 | Gibberd | 405/228 |
| 2011/0158752 | A1 * | 6/2011 | Hitchin | 405/232 |
| 2012/0177447 | A1 * | 7/2012 | Fraenkel et al. | 405/232 |

FOREIGN PATENT DOCUMENTS

| | | | |
|---|---|---|---|
| DE | 85 35 088 | U1 | 8/1988 |
| DE | 43 08 856 | C1 | 5/1994 |
| EP | 2 299 006 | A1 | 3/2011 |
| EP | 2 322 724 | A1 | 5/2011 |
| GB | 1 506 388 | | 4/1978 |
| GB | 2 002 047 | A | 2/1979 |
| GB | 2 448 358 | A | 10/2008 |

* cited by examiner

UNDERWATER DRILLING ARRANGEMENT AND METHOD FOR MAKING A BORE

The invention relates to an underwater drilling arrangement for making a bore in a bed of a water body according to the preamble of claim 1. The invention further relates to a method for creating a bore in a bed of a water body according to claim 10.

The underwater drilling arrangement comprises a service platform which can be lowered for positioning on the bed of a water body, like a lake, sea or river bed, a drill drive which is arranged on the service platform, and a drill rod with drill head which can be driven in rotation by means of the drill drive.

The underwater drilling arrangement and the drilling method serve in particular for the creation of foundations or foundation piles in the bed of a lake, sea or river, for example for anchoring offshore wind power plants, flow turbines of tidal power plants or oil and gas conveying facilities in the sea.

An underwater drilling arrangement is known from EP 2 322 724 A1. In this drilling arrangement the drill drive is positioned on an upper collar of a tubular foundation element to be incorporated into the lake, sea or river bed, said foundation element remaining in the lake, sea or river bed after the excavation process. The foundation element to be incorporated into the lake, sea or river bed is guided along a sleeve-like linear guide which is arranged above the lake, sea or river bed on the service platform.

A further underwater drilling arrangement is described in GB 2 448 358 A. The drilling arrangement comprises a service platform with a plurality of hollow supporting feet, through which fixing piles can be introduced into the ground for fixing the service platform on the lake, sea or river bed A device and a method for creating a tubed deep bore is described in DE 43 08 856 C1. The device comprises a drill tube which is driven in rotation by means of a tube rotating apparatus with simultaneous exertion of an advance feed force, wherein in order to excavate drill core material an in-tube drilling unit is used which can be moved in and out of the drill tube hanging on a cable. The in-tube drilling unit can be fixed on the drill tube and entrained in rotating drilling movement through the drill tube and thereby driven.

A further device for creating a tubed bore with a rotary drive which can be fixed in the drill tube is described in DE 27 34 185 C2.

It is the object of the invention to indicate an underwater drilling arrangement and a method for making a bore in the bed of a water body which allow particularly economic creation of an underwater bore.

The object is achieved according to the invention through an underwater drilling arrangement having the features of claim 1 and a method for making a bore in the bed of a lake, sea or river having the features of claim 10. Preferred embodiments of the invention are indicated in the respectively dependent claims.

The underwater drilling arrangement according to the invention is characterised in that the service platform comprises a guide tube, on the tube inner side of which at least one linear guide is arranged, along which at least a part of the drill drive is guided so as to be axially moveable and the guide tube is held so that it can be adjusted and fixed in a mount of the service platform.

The method according to the invention which can be carried out in particular with an underwater drilling arrangement according to the invention comprises the following method steps: A service platform with a guide tube is lowered and positioned on the bed of a water body. A drill rod with drill head is arranged in the guide tube and axially guided, wherein by means of a drill drive the drill rod is driven in rotation. After the bore has been created the service platform is removed and raised with the guide tube again from the bed of the water body.

A first basic idea of the invention can be seen in that the drill drive is guided along an inner side of a tubular guide structure, namely the guide tube, of the service platform. The guide tube thereby assumes quasi the function of an intermediary, along which the drill drive is guided so that it can be moved. Through the drill drive arranged and guided inside the guide tube it is extensively protected from external influences such as for example the flows of the water body, like a lake, sea or river. The guide tube allows in particular a guided movement of the drill drive in the direction in which drilling progresses.

In order to guide the drill drive, the guide tube comprises a guide means extending in axial direction of the guide tube, which guide means is formed as a linear guide. The linear guide can comprise in particular a guide groove extending in axial direction of the guide tube and cooperate with a corresponding guide element of the drill drive. The guide element of the drill drive, for example a guide shoe, is in this respect preferably provided on the outer side of a housing of the drill drive.

The linear guide of the guide tube guarantees a guided, exclusive axial movement of the drill drive inside the guide tube. Through the linear guide the housing of the drill drive can be secured against a rotation relative to the guide tube so that reaction forces, in particular rotation forces, during rotary operation of the drill drive can be absorbed by the guide tube and carried away from it.

A second core idea of the invention consists in that the guide tube is mounted adjustably, in particularly axially movably and/or rotatably, in the mount of the service platform in such a way that the guide tube can be moved during creation of the bore and in particular lowered and raised or rotated. It is further provided according to the invention that the guide tube can be fixed on the mount. In case of the guide tube being fixed it is secured against rotary movement and/or axial movement relative to a base body of the service platform.

The fixed guide tube can serve during operation of the drill drive as an abutment or support for the drill drive. This facilitates the deflection of reaction forces via the guide tube to the base body of the service platform and via this further to the bed of the lake, sea or river. Furthermore, due to its adjustable positioning on the base body of the work platform, in particular during interruption of operation of the drill drive, the guide tube can be subsequently fed in the drilling direction. The guide of the drill drive can thus be downwardly extended in order to facilitate a greater drilling depth. Alternatively or additionally to the axial movement, a rotary movement of the guide tube relative to the base body of the work platform is possible.

It is particularly preferred according to the invention to incorporate the guide tube at least partially itself into the bed of the water body in order to facilitate guiding of the drill drive both above and below the bed of the water body.

The guide tube as part of the service platform of the underwater drilling arrangement is raised again after creation of the bore and removed together with the base frame of the service platform from the bed of the water body.

According to a preferred embodiment of the invention it is provided that the drill drive comprises a drill drive upper part and a drill drive lower part which can be moved axially relative to each other. Both the drill drive upper part and the drill drive lower part preferably comprise a feed-through for the drill rod. It is further preferable for the drill drive lower part to be equipped with an entraining means which brings about a coupling of the drill drive lower part and drill rod for a common axial movement. The drill drive upper part and/or the drill drive lower part are preferably mounted on the guide tube so that they can be fixed and released. The drill drive lower part can comprise at least one outwardly pointing guide element which cooperates for axial guiding with the at least one linear guide.

The drill drive upper part and/or the drill drive lower part is/are preferably adjustable relative to the guide tube. Through the adjustable, in particular axially movable mounting, the drill drive upper part and/or drill drive lower part can be moved along the whole length of the guide tube in order—with the guide tube fixed—to create a bore with approximately the length of the guide tube.

The drill drive upper part and the drill drive lower part can preferably be fixed on the guide tube independently of each other. In order to carry out a drilling step it is particularly preferable for the drill drive upper part to be fixed in the guide tube and for the drill drive lower part—with fixed drill drive upper part—to be movable together with the drill rod axially in the guide tube.

The advance feed movement of the drill rod with drill head can in principle be achieved by gravity. It is particularly preferable, however, for an axial actuator unit to be arranged for moving the drill drive lower part relative to the drill drive upper part. The actuator unit which can also be described as a feed unit facilitates control of the load on the drill head which is optimised in relation to requirements, in particular by increasing or reducing the load caused by gravity.

In order to control the load or the pressing force it is provided in particular to tension the drill drive upper part in the guide tube and through the actuator unit to exert an axial force on the drill drive lower part so that a defined pressing force is transferred to the drill head.

An advantageous axial actuator unit is given in that this comprises at least one, preferably three, hydraulic cylinders. The hydraulic cylinder(s) can be arranged in a space-saving manner within the guide tube. A plurality of hydraulic cylinders are preferably arranged symmetrically about a central longitudinal axis of the drill rod.

In particular for rotating the guide tube into the bed of the lake, river or sea, it is preferred that the guide tube is mounted so that it can be rotated and axially moved in the mount and that a rotary drive for rotating the guide tube is arranged on the service platform. For deep rotation of the guide tube into the bed of the lake, sea or river it is preferable for the guide tube to be able to be extended upwards, possibly so far that it projects over the surface of the water.

A particularly robust rotary drive which also facilitates a secure fixing of the guide tube on the base body of the service platform is provided in that the rotary drive comprises at least one hydraulically clampable collet for clamping the guide tube and the collet can be rotated with at least one horizontal cylinder. The horizontal cylinder is connected in this respect on the one hand to the collet and on the other hand to the base body of the service platform. The thus formed rotary drive facilitates an intermittent rotation of the guide tube through tensioning the collet, rotating the collet by means of the horizontal cylinder, releasing the collet, feeding back the collet and renewed tensioning and rotation.

The incorporation of the guide tube in the bed of the lake, sea or river can be facilitated in that the guide tube comprises a cutting means on its lower side. The cutting means can in particular comprise a cutting ring with cutting teeth which is formed on the axial end face of the guide tube.

In order to increase the load on the drill head it is preferable for load plates to be arranged on the drill rod above the drill head. The load plates can be arranged in particular releasably on the drill rod, in particular being positioned on said drill rod. In this respect the load plates comprise a central feed-through for the drill rod. A variable number of load plates can preferably be arranged on the drill rod.

For secure fixing or tensioning of the drill drive upper part and/or the drill drive lower part on the guide tube it is preferable for the drill drive upper part and/or the drill drive lower part to comprise at least one locking means with an adjustable locking element. A plurality of support elements, for example inwardly projecting wedges or notches formed in the tube inner wall, are preferably provided on the guide tube distributed along its length, which optionally cooperate with the locking element for the formation of a shape-locking connection. This facilitates an axial fixing of the corresponding drive part at different points of the guide tube. By releasing the locking element, axial moveability of the corresponding drive part can be guaranteed.

The support elements are preferably arranged in the region of the linear guide on the guide tube. The adjustable locking elements on the drill drive are preferably arranged in the region of a guide element of the drill drive which cooperates with the linear guide. A locking cylinder, in particular a hydraulic cylinder, is preferably provided for adjusting the locking element.

It is preferred in terms of the method for the drill drive upper part of the drill drive to be fixed on an upper side of the guide tube and the drill drive lower part to be guided along at least one linear guide on an inner side of the guide tube and axially moved together with the drill rod. The drill head arranged on the drill rod thereby creates a bore, preferably going ahead of the guide tube.

The pressing force of the drill head can be brought about in principle by the specific weight of the drill head and drill rod and the possibly arranged load plates. It is particularly preferable, however, for the contact force of the drill head to be controlled by means of an axial actuator unit which is arranged between the drill drive upper part and the drill drive lower part. The axial actuator unit, for example at least one hydraulic cylinder, can increase or reduce the pressing force provided by the specific weight of the drill rod and the possibly arranged load plates. It is hereby purposefully possible to produce a predefined pressing force which can be changed during drilling operation.

The bore depth with predefined length of the guide tube can be enlarged according to the invention advantageously in that the drill rod is telescopic or can be extended by inserting an intermediate element. In order to insert the intermediate element the drill drive is drawn out of the guide tube remaining in the ground, connected to the intermediate element and introduced again into the guide tube.

According to a further preferred embodiment of the method according to the invention it is provided that in order to carry out a drilling step the drill drive lower part is moved out by a defined stroke distance relative to the drill drive upper part and that subsequently the guide tube is introduced further into the bore and thereby the drill drive lower part is again moved into the drill drive upper part so that a further drilling step can be carried out.

According to this embodiment of the method therefore the drill head and guide tube are thus driven in steps and alternately into the bed of the water body. The drill head is thereby preferably introduced into the ground ahead of the guide tube. As the guide tube must therefore only further enlarge the bore the advance feed force for lowering the guide tube is comparatively small. After the maximum penetration depth of the guide tube has been achieved the guide tube can further serve as a guide means for the drill drive and the drill drive can be moved along the guide tube as far as the lower end of the guide tube. The maximum drilling depth thus corresponds to approximately the sum of the lengths of the guide tube and the possibly extended drill rod.

In order to create the bore with fixed guide tube the process is as follows: After the drill drive lower part has been moved downwards and the at least one hydraulic cylinder maximally moved out, the drill drive lower part is fixed on the guide tube and the drill drive upper part is released from the guide tube and moved in the direction of the drill drive lower part. By renewed fixing of the drill drive upper part to the guide tube and releasing the drill drive lower part, a further drilling step can be carried out. In this way it is possible to create, with fixed guide tube, a bore approximately with the length of the guide tube, whereby the drill drive upper part and the drill drive lower part are moved in steps and alternating in the described way. This method can be carried out independently of the position of the guide tube, thus also in case of the guide tube not being rotated or not completely rotated.

According to a further preferred embodiment of the method the excavated earth material is removed from the bore via a flushing channel in the drill rod and expelled above the drill drive. Such a so-called flushing-drilling process allows a comparatively simple removal of the excavated earth material. In order to incorporate flushing liquid a feed channel is provided beside the flushing channel.

Figure 2:
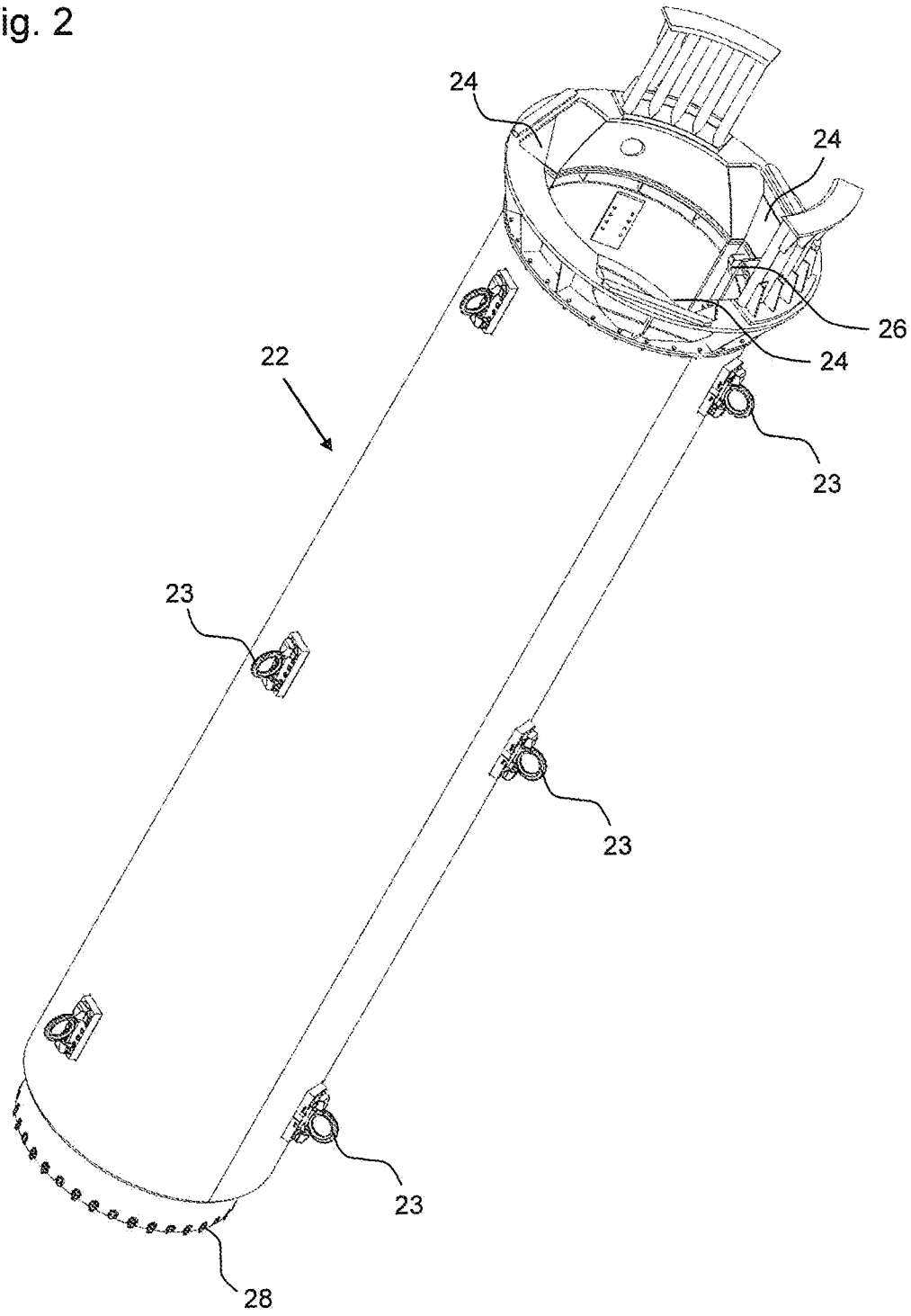
Figure 3:
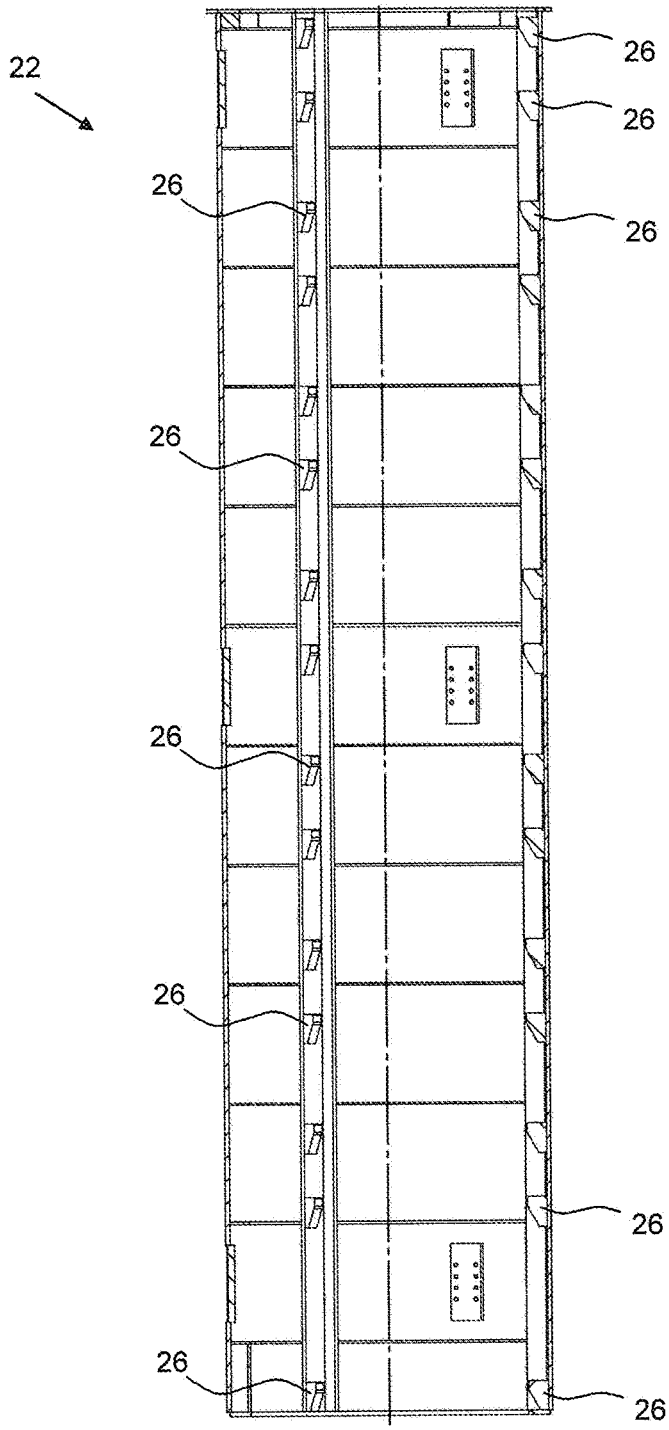
Figure 4:
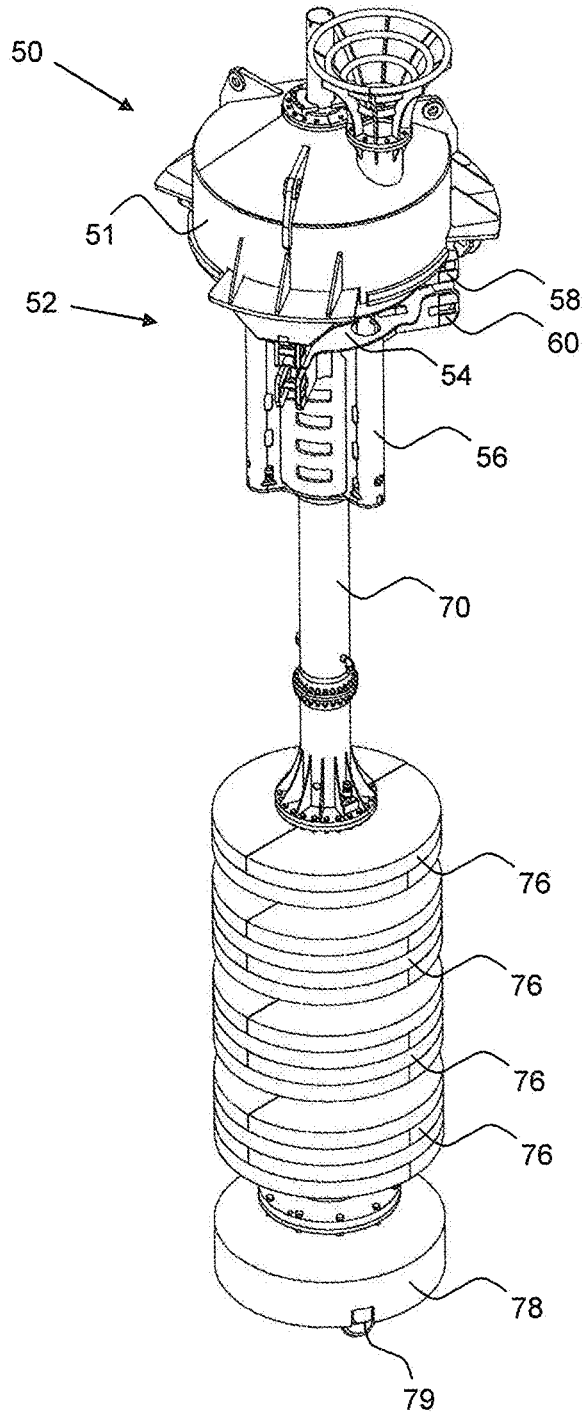
Figure 5:
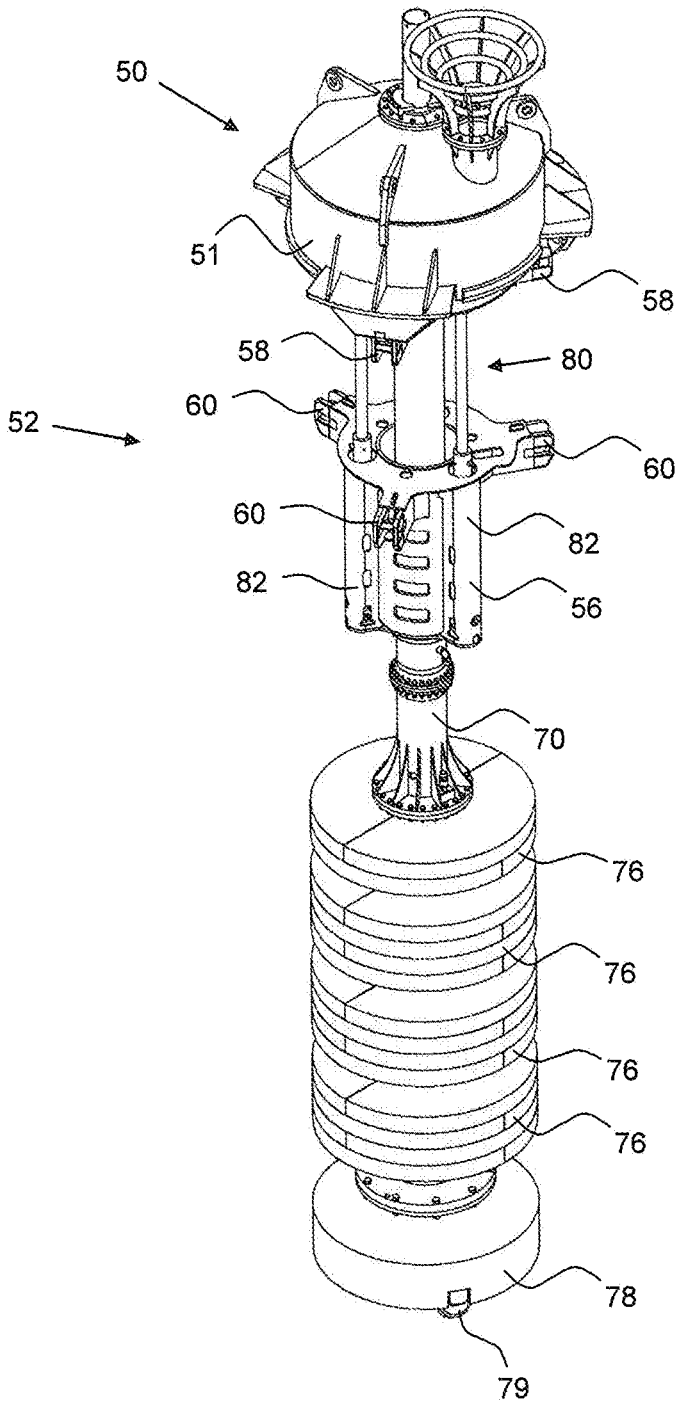
Figure 6:
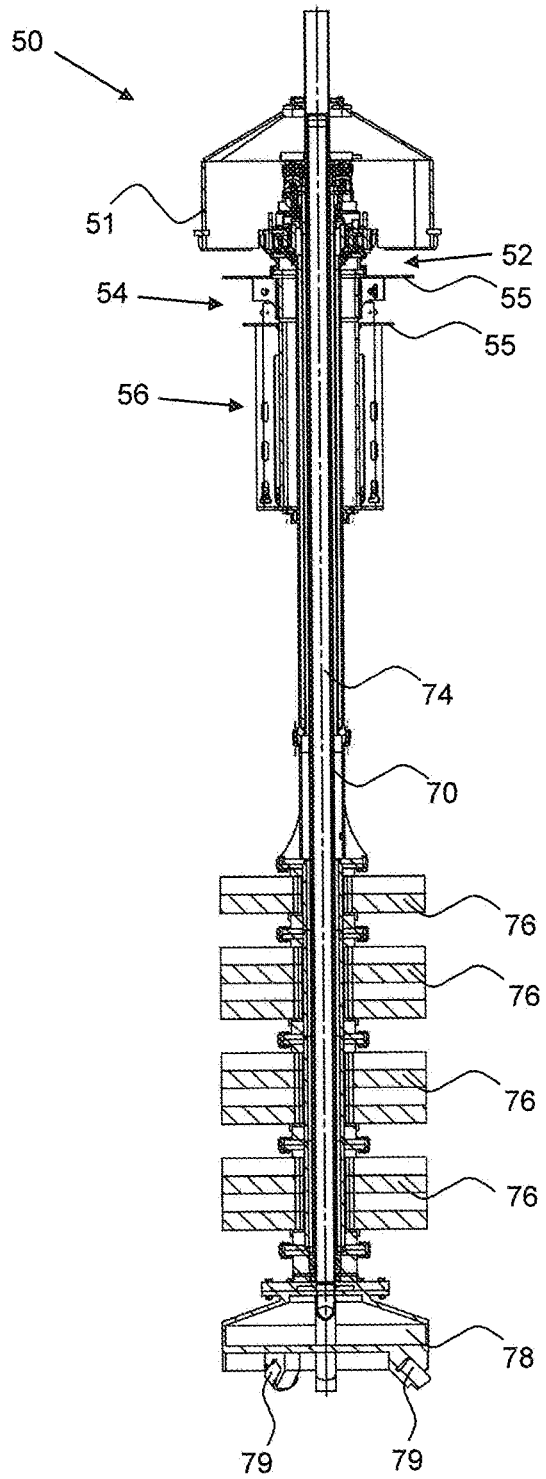
Figure 7:
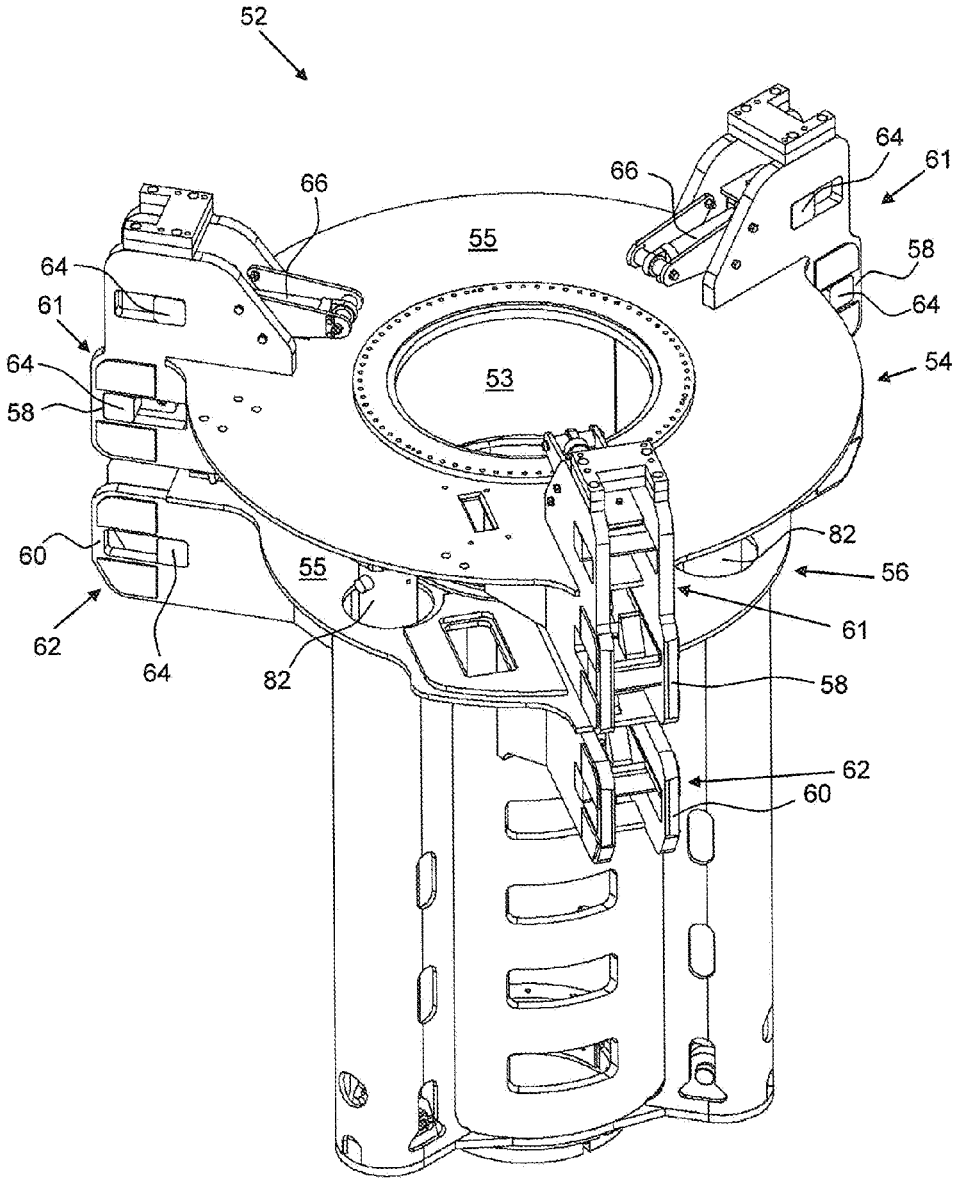
Figure 8:
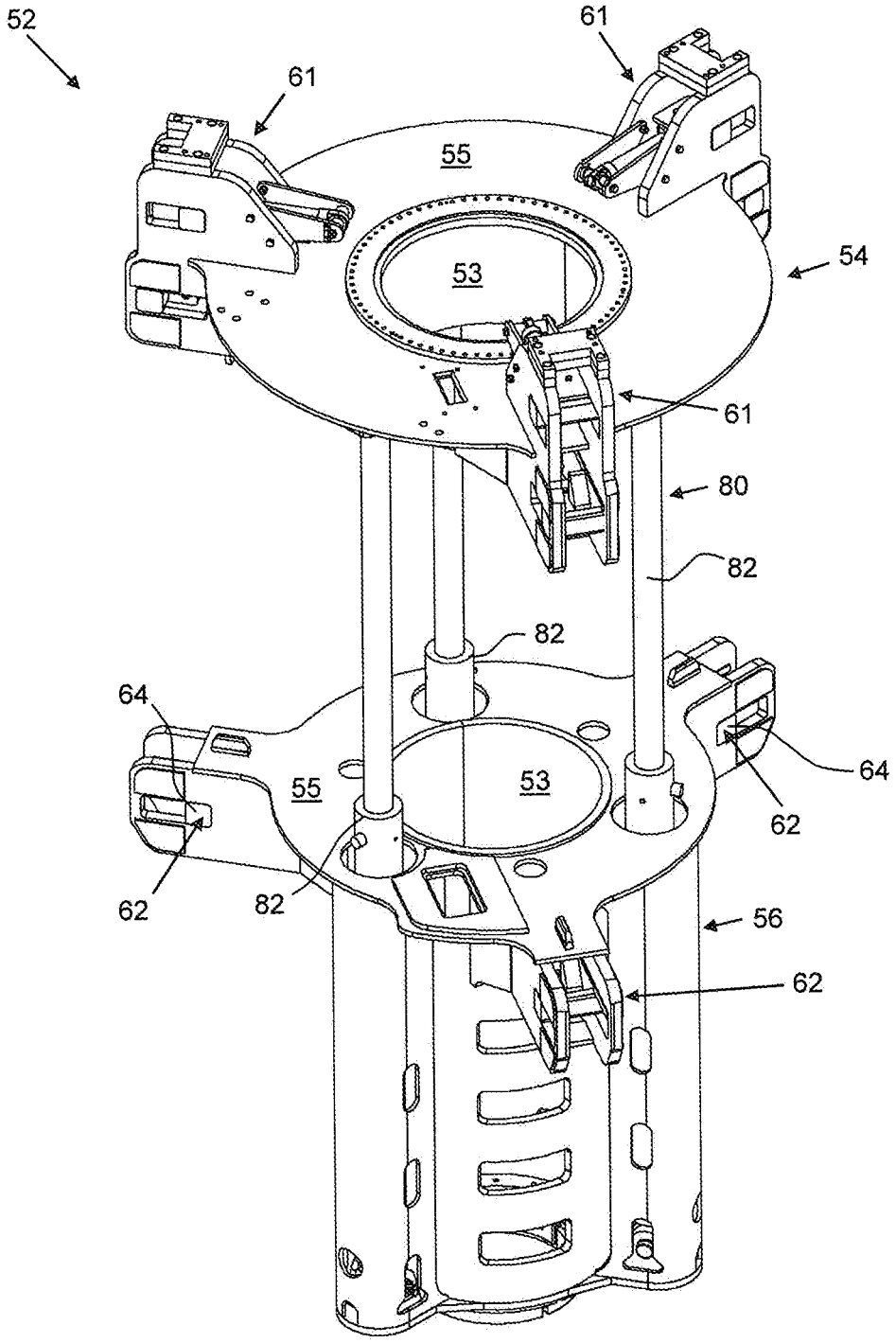
Figure 9:
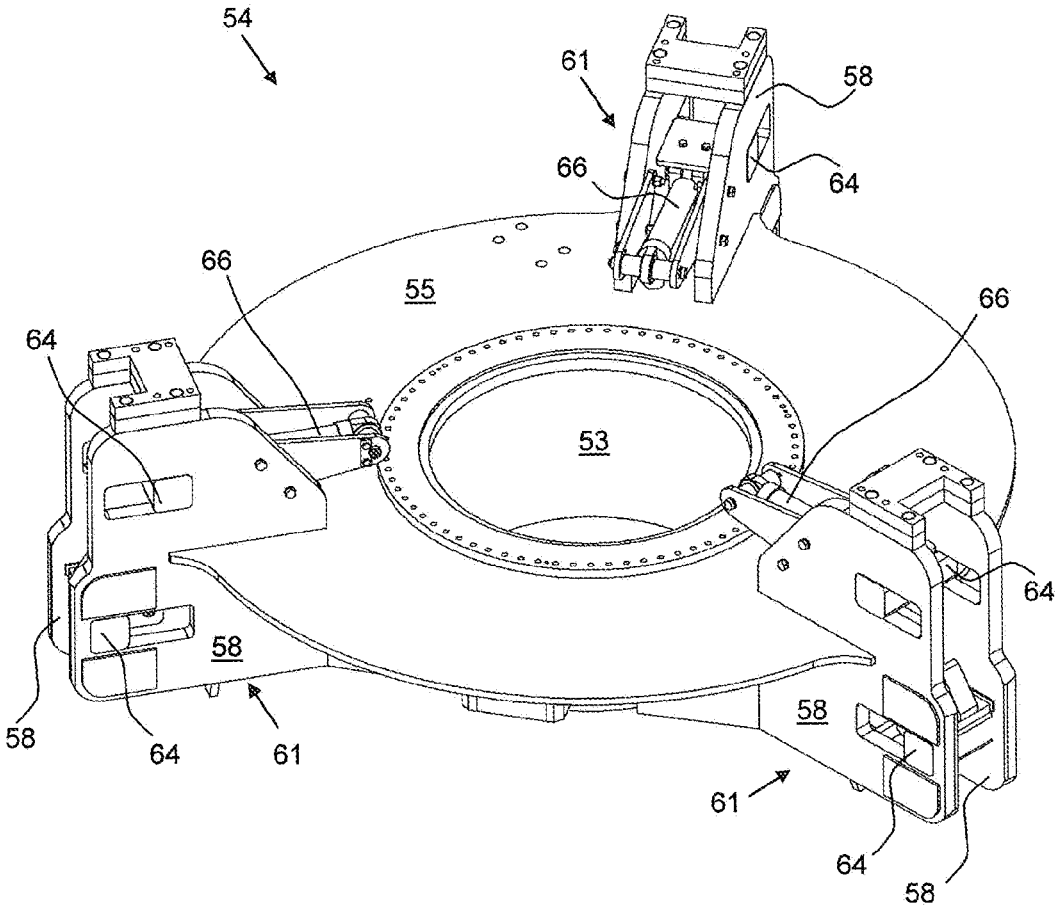
Figure 10:
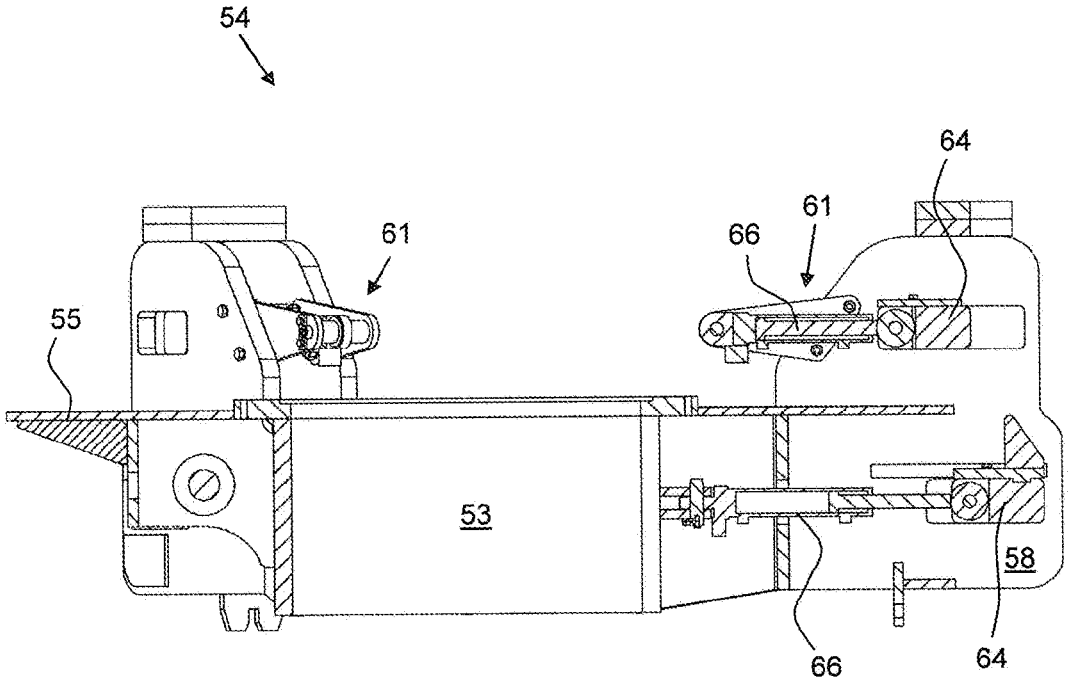
Figure 11:
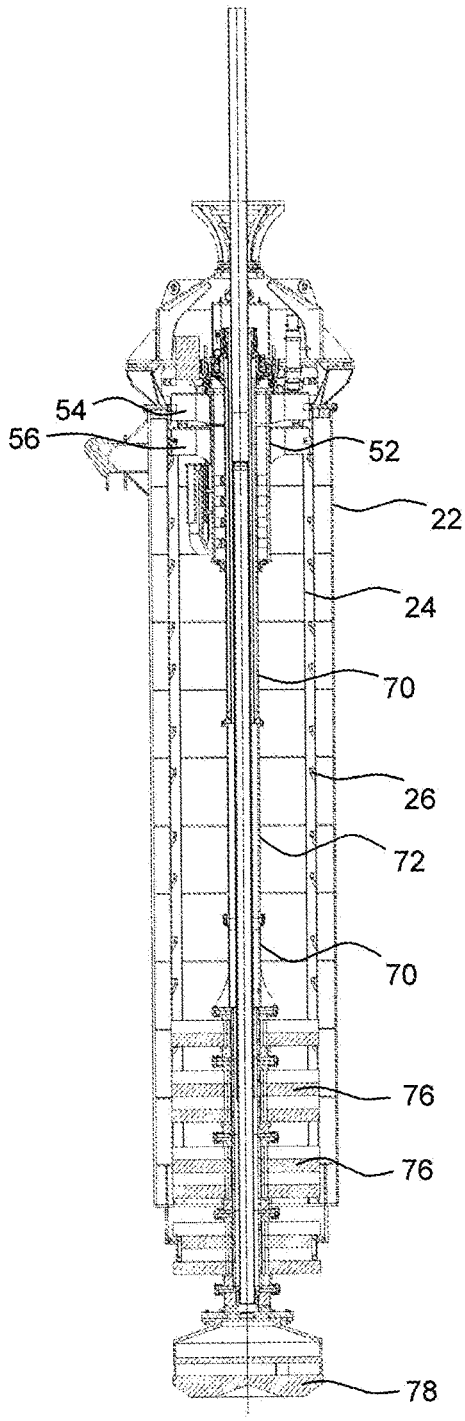
Figure 12:
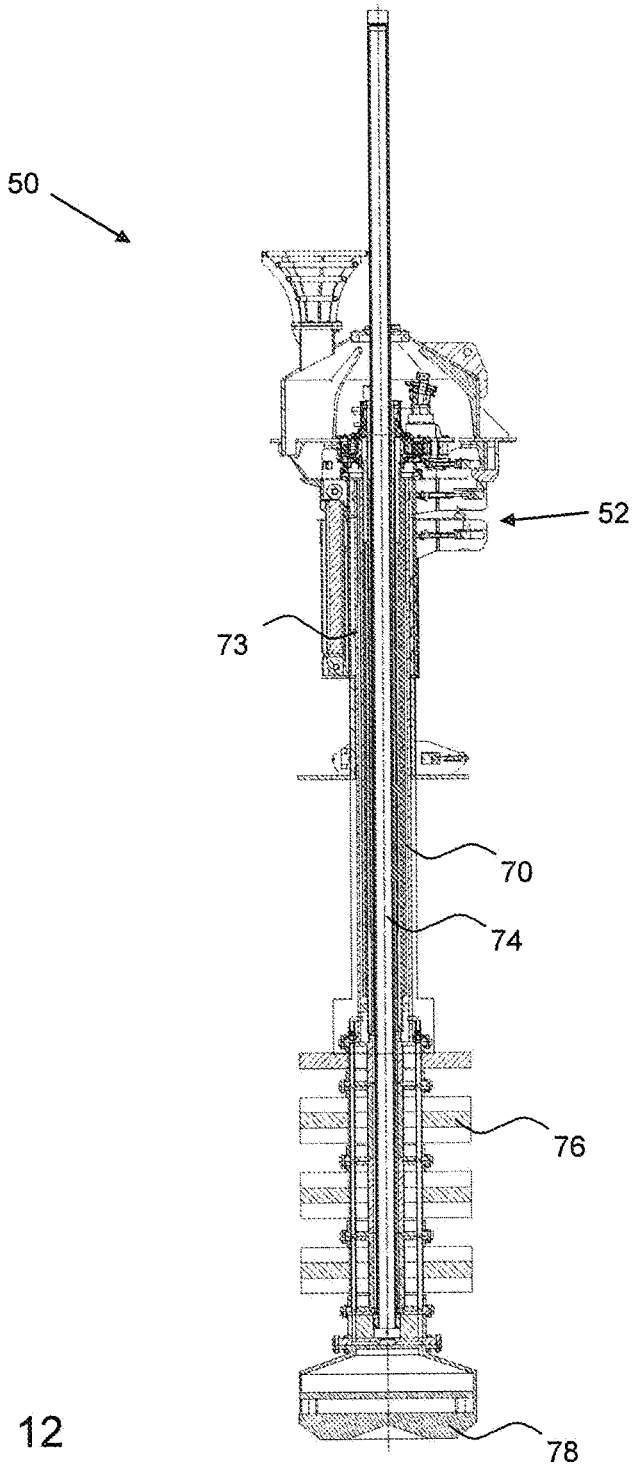

The invention is described in further detail below by reference to preferred embodiments which are shown in the attached schematic drawings, in which:

FIG. 1 shows a side view of an underwater drilling arrangement;

FIG. 2 a perspective view of a guide tube;

FIG. 3 a cross-sectional view of the guide tube of FIG. 2;

FIG. 4 a perspective view of a drilling unit in a base position;

FIG. 5 the drilling unit of FIG. 4 with a drill drive lower part which is moved out relative to a drill drive upper part;

FIG. 6 a sectional illustration of the drilling unit of FIG. 4;

FIG. 7 a perspective view of a drill drive in a base position;

FIG. 8 the drill drive of FIG. 7 with a drill drive lower part moved out relative to a drill drive upper part;

FIG. 9 a perspective view of a drill drive upper part;

FIG. 10 the drill drive upper part of FIG. 9 in a sectional view;

FIG. 11 a drilling unit arranged in a guide tube with a drill rod extended by an intermediate element;

FIG. 12 a drilling unit with a telescopic drill rod; and

Figure 13:
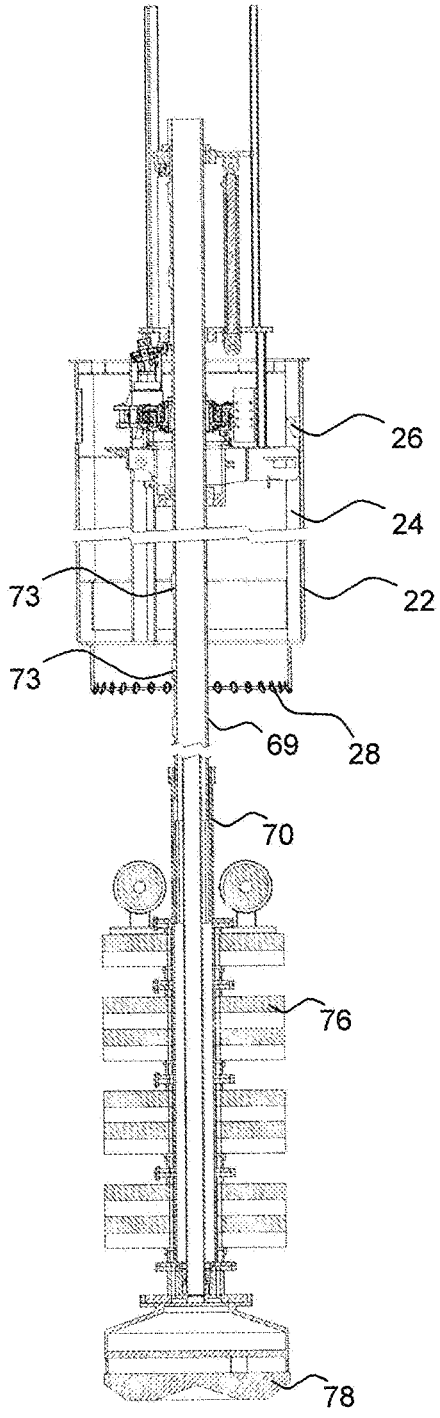

FIG. 13 a drilling unit with a drill rod extended by a Kelly rod.

Equivalent elements are identified in all the figures by the same reference numerals.

FIG. 1 shows an underwater drilling arrangement 10 according to the invention with a service platform 20 which can be positioned on a bed of a water body, like a lake, sea or river and a drilling unit 50 guided on the service platform 20. The service platform 20 comprises a base body 30 which can also be referred to as a base frame. The base body 30 comprises a plurality of erection feet 32 for erection on the bed of the lake, sea or river. The erection feet 32 are preferably designed so that they can be adjusted in such a way that unevenness in the bed of the lake, sea or river can be compensated and the service platform 20 can be erected in the desired orientation, in particular horizontally, on the bed of the lake, sea or river. The base body 30 further comprises a plurality of struts 34 and a central mount 36 for a guide tube 22. The guide tube 22 is mounted as part of the service platform 20 so that it is adjustable in the mount 36.

In order to rotate the guide tube 22 relative to the base body 30 a rotary drive 40 is provided on the base body of the service platform 20. The rotary drive 40 comprises a hydraulically clampable collet 42 which can be rotated by means of a horizontal cylinder 44. In order to apply a vertical force to the guide tube 22 a vertical cylinder 46 is further provided.

A guide tube 22 according to the invention is shown in FIGS. 2 and 3. The guide tube 22 comprises at its lower end a cutting means 28 with a plurality of cutting teeth which are arranged in a ring. The guide tube 22 comprises a cylindrical outer shell surface. A plurality of securing elements 23 for securing the guide tube 22 relative to the base body 30 are arranged on the outer periphery of the guide tube 22.

A linear guide 24 is formed on the inner shell surface or inner wall of the guide tube 22, said linear guide 24 comprising in the embodiment shown three grooves extending in the longitudinal direction of the guide tube 22. Furthermore wedge-like support elements 26 are provided on the inner shell surface of the guide tube 22 which can also be described as locking pins, locking wedges or guide wedges. A plurality of support elements 26 are arranged at equal distances along the longitudinal direction of the guide tube 22. In the embodiment shown the support elements 26 are in the region of the linear guide 24, that is to say in the longitudinal grooves of the guide tube 22. The radial expansion of the support elements 26 is smaller than or equal to the depth of the grooves formed in the guide tube 22 so that the support elements 26 do not project over the cylindrical inner shell surface of the guide tube 22.

A drilling unit 50 can be arranged on the guide tube 22 which is shown in greater detail in FIGS. 4 to 6. As can be deduced in particular from FIG. 1, the drilling unit 50 can be positioned on the guide tube 22 or at least partially introduced therein by means of a cable (not shown).

The drilling unit 50 comprises a drill drive 52 for driving a drill rod 70 with a drill drive head element 51 which can be placed on the guide tube 22 and also a drill drive upper part 54 which can be axially moved in the guide tube 22 and an also movable drill drive lower part 56. The drill drive 52 serves on the one hand for driving in rotation the drill rod 70 and on the other hand for axial advancing of the drill rod 70 in order to create a bore in the bed of a lake, sea or river. At the lower end of the drill rod 70, a drill head 78 is arranged, on which drilling tools 79 are fixed. The drilling unit 50 can be equipped with drilling tools 79 of many types, for example roller bits, cross-cutters, both optionally with air lift pump, drilling auger or drilling bucket. A flushing channel 74 is provided in the drill rod 70 for carrying out a flushing—drilling process.

The pressing force necessary for drilling is applied via ballast weights, in particular load plates 76. The load plates 76 are arranged between the drill drive 52 and the drill head 78 on the drill rod 70, in particular the so-called drill collar. The drilling unit 50 can thus also be designated as a gravity drilling unit, in which the load of the drilling head is extensively provided by gravity.

Details of the drill drive upper part 54 and the drill drive lower part 56 are shown in FIGS. 7 to 10.

Both the drill drive upper part 54 and the drill drive lower part 56 have a central opening 53 as a feed-through for the drill rod 70.

The drill drive upper part 54 comprises a plurality of guide elements 58, three in the exemplary embodiment shown, which can be brought into engagement with the guide grooves of the guide tube 22. The drill drive lower part 56 comprises corresponding guide elements 60.

In the region of the guide elements 58, locking means 61 are arranged on the drill drive upper part 54, with which locking means 61 the drill drive upper part 54 can be locked in a shape-locking way relative to the guide tube 22. The locking means 61 respectively comprise an adjustable locking element 64 and a hydraulic locking cylinder 66 for actuating the locking element 64. Correspondingly, locking means 62 with locking element 64 and locking cylinder 66 are arranged on the drill drive lower part 56.

By means of the locking means 61, 62 arranged on the drill drive upper part 54 and on the drill drive lower part 56, the drill drive upper part 54 and the drill drive lower part 56 can be tensioned or fixed independently of each other in the guide tube 22. The locking means 61, 62 can accordingly also be described as clamping or tensioning means.

The guide elements 58, 60 and the locking means 61, 62 are respectively arranged on transverse elements 55 of the drill drive upper part 54 or the drill drive lower part 56.

In order to move the drill drive lower part 56 relative to the drill drive upper part 54 an axial actuator 80 is arranged between the drill drive upper part 54 and the drill drive lower part 56. The actuator 80 comprises a plurality of advance feed cylinders, three in the exemplary embodiment shown, which are designed as hydraulic cylinders 82. The drill rod 70 is axially fixedly coupled to the drill drive lower part 56. By moving the drill drive lower part 56 relative to the drill drive upper part 54, an advance feed force can be applied to the drill rod 70 and the drill head 78. The load on the drill head 78 can hereby be controlled.

The length of the guide tube 22 does not limit the drilling depth as the drill rod 70 can be extended. FIG. 11 shows a drilling unit 50 arranged in a guide tube 22 with drill drive upper part 54, drill drive lower part 56, drill rod 70 and drill head 78. The drill rod is extended by means of an intermediate element 72 which is arranged between the drill drive 52 and the drill head 78. The drill head 78 thus projects—if the drill drive 52 is arranged upwardly in the guide tube 22—downwards beyond the guide tube 22. Through the extended drill rod 70 a greater drilling depth can be achieved.

In order to extend the drill rod 70 the drilling unit 50 is removed from the guide tube 22, the rod is extended and the drilling unit 50 introduced again into the guide tube 22.

A drilling unit 50 with a telescopic drill rod is shown in FIG. 12. The drill rod 70 is telescopically formed above the load plates 76. Entraining elements or holding wedges 73 are arranged on the outer periphery of the telescopic part of the drill rod 70, said entraining elements or holding wedges 73 being in engagement with the drill drive lower part 56 in order to move the drill rod 70 axially.

FIG. 13 shows a drill rod with a Kelly extension. The entraining elements or holding wedges 73 are arranged here on the outer periphery of a Kelly rod 69 which can be moved out.

An inventive drilling process for creating a bore in a bed of a lake, sea or river is described below.

Firstly the service platform 20 including guide tube 22 is lowered by means of a cable (not shown) from a support unit arranged on the water surface, for example a platform or a vessel, and erected at the bottom of the lake, sea or river. The service platform 20 is then orientated and can additionally be fixed to the ground.

After the work platform 20 has been arranged in the desired orientation on the bed of the lake, sea or river, a drilling unit 50 with a drill drive 52, a drill rod 70 and a drill head 79 is introduced into the guide tube 22. The drill drive upper part 54 is tensioned by means of the upper locking means 61 in the guide tube 22 in a shape-locking way. The drill rod 70 is driven in rotation by the drill drive 52 and a first drilling step is carried out. During progress of the drilling which is regulated by means of the load control the drill head 78 travels, with fixed guide tube 22, together with the drill drive lower part 56 downwards until the hydraulic cylinders 82 of the feed unit 80 have been completely moved out.

According to a first embodiment of the method the drill head 78 and guide tube 22 are drilled alternately step-wise into the ground. For this purpose, if the hydraulic cylinders 82 have been completely moved out, the drill head 78 which hangs by means of the upper locking unit 61 in the guide tube 22 is withdrawn again from the bottom of the bore. The hydraulic cylinders 82 are moved in again. The drill drive lower part 56 is tensioned in a shape-locking way by means of the lower locking means 62 provided thereon in the guide tube 22 so that the drilling unit 50 is again fixed in the guide tube. The guide tube 22 is rotated by means of the rotary drive 40 approximately as far as the bore bottom. The lower locking means 62 is released so that the drill drive lower part 56 is again axially movable and a further drilling step can be carried out.

In a further embodiment of the method the drill head 79 is rotated in a plurality of successive drilling steps, with fixed guide tube 22, into the ground. If the hydraulic cylinders 82 have been completely moved out in the first drilling step, the drill drive lower part 56 is tensioned in a shape-locking way by means of the lower locking means 62 provided there in the guide tube 22. Subsequently the upper locking means 61 is released and the drill drive upper part 54 is moved downwards along the guide tube 22 until the hydraulic cylinders 82 are moved in again. The drill drive upper part 54 is then tensioned again within the guide tube 22 and the tensioning of the drill drive lower part 56 is released. A further drilling step can then be carried out.

As soon as the drill drive 52 has reached the lower end of the guide tube 22 said guide tube 22 can be drilled in along the bore created by actuating the rotary drive 40. The drilling unit 50 is thereby preferably withdrawn within the guide tube 22, thus not projecting downwardly.

The invention claimed is:

1. Underwater drilling arrangement for making a bore in a bed of a water body, comprising a service platform which can be lowered for positioning on the bed of the water body, a drill drive which is arranged on the service platform, and a drill rod with drill head which can be rotatably driven via the drill drive, wherein the service platform comprises a guide tube, on the inner side of which at least one linear guide is arranged, along which at least a part of the drill drive is guided so that it can be moved axially, and the guide tube is held so that it can be adjusted and fixed in a mount of the service platform; and the drill drive comprises a drill drive upper part and a drill drive lower part which can be moved axially relative to each other and at least the drill drive lower part comprises at least an outwardly pointing guide element which cooperates for axially guiding with the at least one linear guide.

2. Underwater drilling arrangement according to claim 1, wherein the drill drive upper part and/or the drill drive lower part can be adjusted relative to the guide tube.

3. Underwater drilling arrangement according to claim 1, wherein an axial actuator is provided for moving the drill drive lower part relative to the drill drive upper part.

4. Underwater drilling arrangement according to claim 3, wherein the axial actuator comprises at least one hydraulic cylinder.

5. Underwater drilling arrangement according to claim 1, wherein the guide tube is mounted so as to be rotatable and axially movable in the mount, and a rotary drive for rotating the guide tube is arranged on the service platform.

6. Underwater drilling arrangement according to claim 5, wherein the rotary drive comprises at least one hydraulically clampable collet for clamping the guide tube and the collet can be rotated with at least one horizontal cylinder.

7. Underwater drilling arrangement according to claim 1, wherein the guide tube comprises a cutting means on its lower side.

8. Underwater drilling arrangement according to claim 1, wherein load plates are arranged on the drill rod above the drill head.

9. Underwater drilling arrangement according to claim 3, wherein the axial actuator comprises three hydraulic cylinders.

10. Method for making a bore in a bed of a water body, comprising:

lowering a service platform having a guide tube and positioning the service platform on the bed of the water body, arranging and axially guiding a drill rod with drill head in the guide tube, whereby the drill rod is driven in rotation by means of a drill drive, and after creating the bore, removing the service platform with the guide tube and raising the service platform with the guide tube from the bed of the water body, wherein a drill drive upper part of the drill drive is fixed on an upper side of the guide tube and a drill drive lower part is guided along at least one linear guide on an inner side of the guide tube and axially moved together with the drill rod.

11. Method according to claim 10, wherein a pressing force of the drill head is controlled by means of an axial actuator which is arranged between the drill drive upper part and the drill drive lower part.

12. Method according to claim 10, wherein in order to carry out a drilling step the drill drive lower part is moved out by a defined stroke distance relative to the drill drive upper part, subsequently the guide tube is brought into the bore and the drill drive lower part is moved into the drill drive upper part again so that a further drilling step can be carried out.

13. Method according to claim 10, wherein the drill rod is telescopic or is lengthened by using an intermediate element.

14. Method according to claim 10, wherein the excavated earth material is removed from the bore via a flushing channel in the drill rod and expelled above the drill drive.

* * * * *